US011135802B2

(12) United States Patent
Schalk et al.

(10) Patent No.: US 11,135,802 B2
(45) Date of Patent: Oct. 5, 2021

(54) DEVICE FOR MACHINE-MAKING A DUNNAGE PRODUCT

(71) Applicant: Sprick GmbH Bielefelder Papier- und Wellpappenwerke & Co., Bielefeld (DE)

(72) Inventors: Bastian Schalk, Lage (DE); Christoph Engemann, Warburg (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 210 days.

(21) Appl. No.: 15/526,700

(22) PCT Filed: Nov. 4, 2015

(86) PCT No.: PCT/EP2015/075665
§ 371 (c)(1),
(2) Date: May 12, 2017

(87) PCT Pub. No.: WO2016/075001
PCT Pub. Date: May 19, 2016

(65) Prior Publication Data

US 2017/0313016 A1 Nov. 2, 2017

(30) Foreign Application Priority Data

Nov. 14, 2014 (DE) ..... 10 2014 016 874.3

(51) Int. Cl.
*B31D 5/00* (2017.01)
*B26D 7/18* (2006.01)
(Continued)

(52) U.S. Cl.
CPC ..... *B31D 5/0039* (2013.01); *B26D 1/185* (2013.01); *B26D 7/18* (2013.01); *B26F 1/20* (2013.01);
(Continued)

(58) Field of Classification Search
None
See application file for complete search history.

(56) References Cited

U.S. PATENT DOCUMENTS 1,509,838 A * 9/1924 Hudson ..... B26F 1/20 493/355
2,882,802 A * 4/1959 Walker ..... B31F 1/08 493/45
(Continued)

FOREIGN PATENT DOCUMENTS

DE 4439224 A1 * 5/1996 ..... B26D 9/00
DE 10 2012 018941 A1 3/2014
(Continued)

OTHER PUBLICATIONS

German/English translation of International Preliminary Report on Patentability dated May 16, 2017.
International Search Report dated Jan. 21, 2016.

*Primary Examiner* — Hemant Desai
*Assistant Examiner* — Tanzim Imam
(74) *Attorney, Agent, or Firm* — Schiff Hardin LLP

(57) ABSTRACT

In a device for machine-making a dunnage product from a single- or multi-ply continuous paper web comprising a delivery conveyor for drawing in a paper web into the device whereby a conveying direction is defined and a cutter for separating the dunnage product from a three-dimensional strand of dunnage material formed from the paper web within the device, it is provided that a removal conveyor succeeds in the conveying direction to the cutter, the removal conveyor transporting the separated dunnage product away from the cutter.

23 Claims, 2 Drawing Sheets

Figure 1:
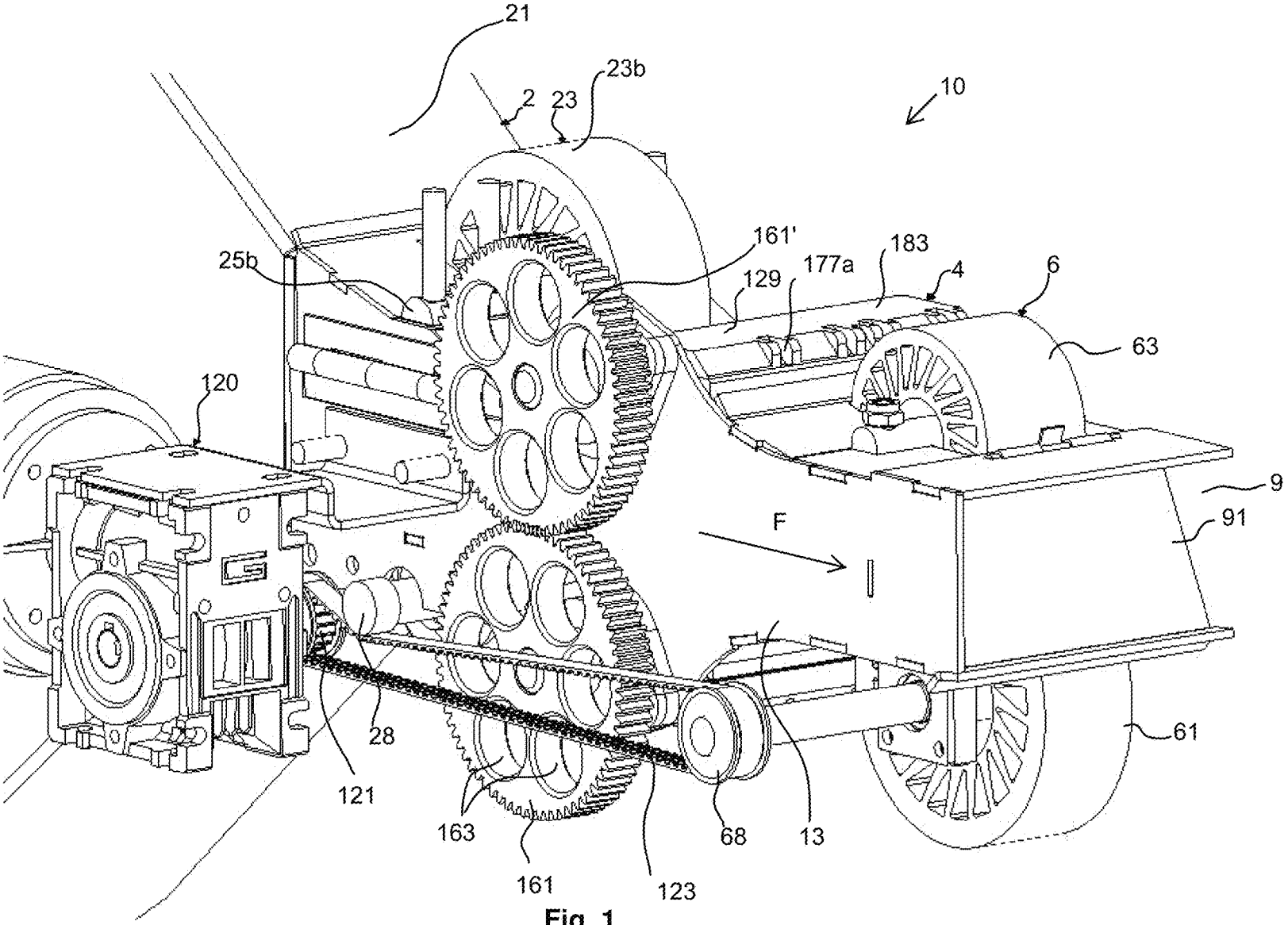

(51) Int. Cl.
*B26F 1/20* (2006.01)
*B26D 1/18* (2006.01)
*B26F 1/08* (2006.01)

(52) U.S. Cl.
CPC ..... *B26F 1/08* (2013.01); *B31D 2205/007* (2013.01); *B31D 2205/0047* (2013.01); *B31D 2205/0058* (2013.01)

(56) References Cited

U.S. PATENT DOCUMENTS 4,545,780 A * 10/1985 Martin ..... B31F 1/2822 493/11
5,203,761 A * 4/1993 Reichental ..... B26D 1/185 493/346
5,643,167 A * 7/1997 Simmons ..... B31D 5/0047 493/464
5,906,569 A * 5/1999 Ratzel ..... B26D 1/245 493/363
6,019,715 A * 2/2000 Ratzel ..... B31D 5/0047 493/464
6,080,097 A * 6/2000 Ratzel ..... B23Q 5/348 493/346
6,176,818 B1 * 1/2001 Simmons, Jr. ..... B31D 5/0047 493/346
6,918,489 B2 * 7/2005 Harding ..... B31D 5/0047 206/451
2007/0117703 A1 * 5/2007 Cavaliere, Jr. ..... B31D 5/0052 493/464
2008/0193263 A1 * 8/2008 Wetsch ..... B65H 20/02 414/222.04
2009/0082187 A1 * 3/2009 Cheich ..... B65D 81/03 493/350
2011/0295409 A1 * 12/2011 Mierzejewski ..... B65H 3/06 700/117
2013/0296154 A1 * 11/2013 Sip ..... B31D 5/0047 493/464
2014/0162024 A1 * 6/2014 Deis ..... B31D 5/04 428/154
2016/0207274 A1 7/2016 Schalk et al.

FOREIGN PATENT DOCUMENTS

DE 10 2013 015 875.3 A1 3/2015
EP 0523382 A2 * 1/1993 ..... B26D 1/185
EP 0523382 A2 1/1993
WO 97/31773 A1 9/1997
WO WO-9731773 A2 * 9/1997 ..... B31D 5/0047

* cited by examiner

DEVICE FOR MACHINE-MAKING A DUNNAGE PRODUCT

BACKGROUND

The invention relates to a device for machine-making a dunnage product from single- or multi-ply continuous paper web such as a cushioning or packaging material manufacturing machine. Generic dunnage material manufacturing devices are for example set up as moveable, mobile units in logistic centres in order to provide dunnage material having a tailored length when packing an object. The dunnage material is acquired from a roll of paper web, in particular a roll of recycling-paper, which saves space in relation to the dunnage material itself, or from a stacked web of recycling paper. For manufacturing the dunnage material, the paper web is drawn from the roll and formed such that air enclosures are provided which cause a dampening between the object to be packed and the external container.

In order to be able to quickly pack a large selection of objects to be packed in a transportation safe manner, the objects are stored according to standardized packaging procedures into containers of standard sizes. Thereby it is important that possibly required dunnage material is always available of constant dunnage quality and of predetermined three-dimensional dimensions in order to allow for an efficient workflow and to reduce the costs of logistics.

A known device for machine-making a three-dimensional cushioning product or dunnage product being used in the above-described technical field is described in DE 10 2012 018 941 A1.

The known production device creates dunnage products of pre-tailored width, height and length-dimension from a paper web material. In order to do so, a paper web is delivered in a conveying direction to the known device and subsequently the paper web is deformed into a three-dimensional strand of dunnage material in a deformation station. Downstream in the conveying direction, dunnage products of predetermined length are separated from the strand of dunnage material by a rotary cutter.

When increasing the conveying- and delivery-velocity of the dunnage products with the known device, however, the risk increases that immediately after severing a dunnage product from the strand of dunnage material, the further transportation of the strand of dunnage material running behind (trailing) is impaired by the separated, forward running (leading) dunnage product thus causing a paper jam. Due to high delivery velocities, a conveying material jam often causes a blockage which is only reparable via a manual maintenance operation of operating personnel at the production device which leads to an interruption of the packaging procedure.

It was shown that, in case of a paper jam, operating personnel tends to try to repair the paper jam through the dispensing opening for the dunnage product. Since the cutting blade of a rotary cutter poses a significant risk of injury, common production devices usually comprise additional constructive safety means to prevent any hand-access through the dispensing opening into the production device. This more complex design having safety flaps and the like, however, renders the maintenance procedures required on the production device of the known models more complicated in order to properly remove the paper jam and to put the device into operation again. Additionally, these additional design means increase the investment costs for such a device.

It is an objective of the invention to overcome the disadvantages of the prior art, particularly to provide a device for machine-making a dunnage product having a high delivery velocity with a low likelihood of paper jam, and which also meats high safety demands.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 2:
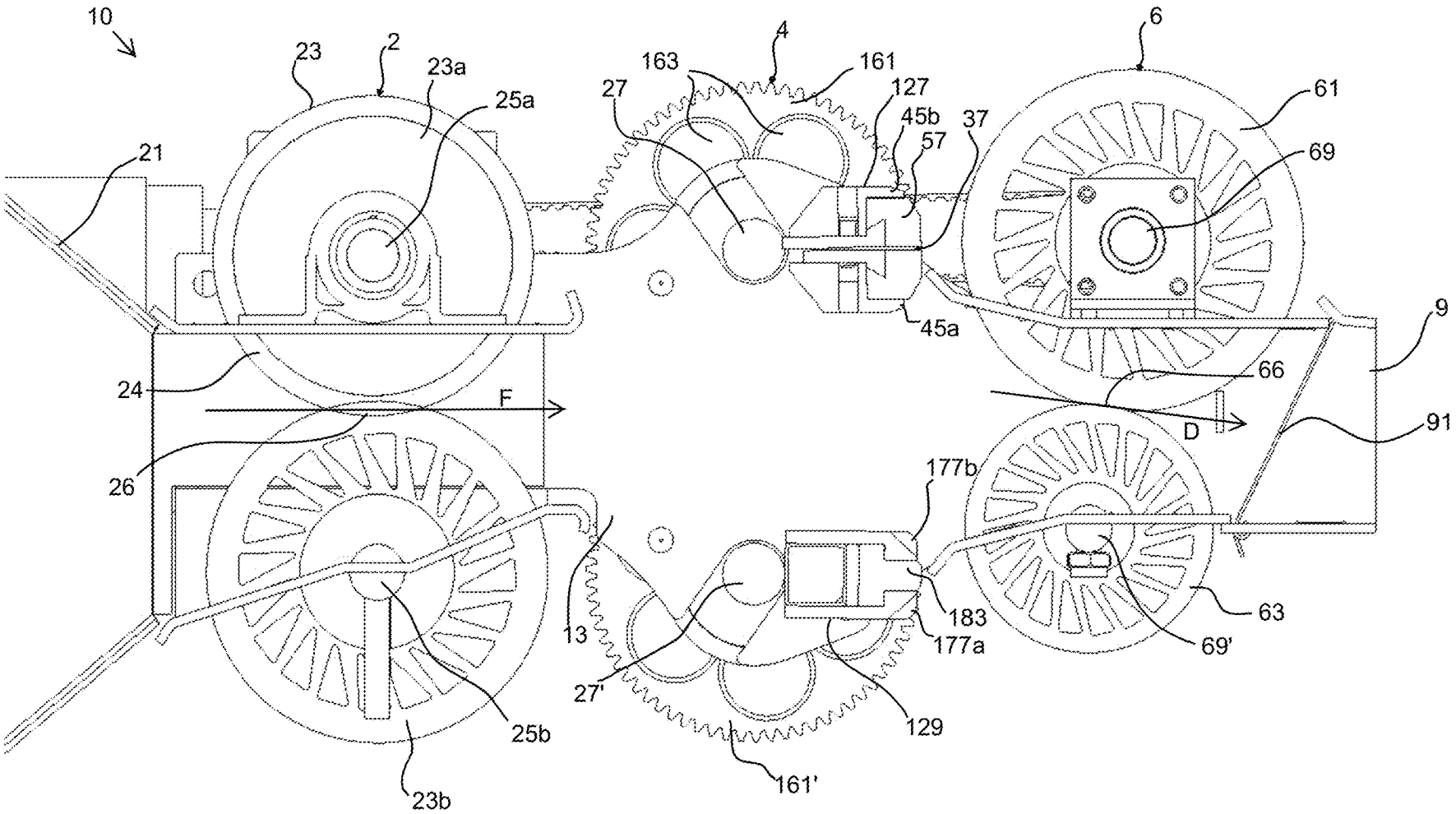

FIG. 1 is a perspective view of an interior design of a production device according to an exemplary embodiment of the present disclosure; and FIG. 2 is a cross sectional view of the production device according to FIG. 1.

The exemplary embodiments of the present disclosure will be described with reference to the accompanying drawings.

DETAILED DESCRIPTION

In the following description, numerous specific details are set forth in order to provide a thorough understanding of the embodiments of the present disclosure.

Embodiments of the present disclosure include a device for machine-making a dunnage product from a single- or multi-ply continuous paper web. The production device or machine-making device comprises a delivery conveyor for drawing the paper web into the device thereby defining a conveying direction, and a cutter for separating the dunnage product from a strand of three-dimensional dunnage material formed from the paper web within the device. According to the invention, a removal conveyor follows up or connects to the cutter in the conveying direction, which removal conveyor transports the separated dunnage product away from the cutter.

By transporting the dunnage product away immediately upon the moment of separation from the trailing strand of dunnage material, a collision of the trailing strand of dunnage material with the dunnage product is avoided. A paper jam in the wake of the cutting device is reliably excluded. With the means according to the invention for removal conveyance of the dunnage product, the dispensing velocity of the production device could be significantly increased and the maintenance-downtimes could be significantly reduced. Maintenance operations due to paper jam in the wake of the separation or cutter device were decreased to an insignificant number. The removal conveyor realizes a sufficient guard against hand access into the area of the cutter device of the production device through the dispensing opening merely be arranging the removal conveyor downstream in the conveying direction relative to the cutter device without requiring any additional constructive means.

The production device works preferably so fully automated that, upon user request, one or several dunnage products are produced (machine-made) and dispensed from the device, in particular without requiring operator intervention. The paper web fed to the device is in particular essentially two-dimensional having predetermined width- and length-dimensions, wherein in particular the length dimension exceeds the width-dimension many times over; the paper web having an insignificant height-dimension represented by the paper web strength. In particular, the device comprises a paper web reception from which the paper web comes into the device through the delivery conveyor. The paper web can be provided by the reception as a roll and/or or stack. The delivery conveyor provides driving forces onto the paper web in a predetermined conveying direction. In particular, the conveying direction falls together with a main extension direction of the production device, in particular of the housing or housing carrier of the production device. Along the path of paper web into and through the production device, the two-dimensional paper web is formed into a three-dimensional strand of dunnage material. In particular, the production device comprises a truncating, narrowing conveying channel. In this conveying channel, the longitudinal edges of the paper web are turned over towards the paper web centerline to form intermediate air spaces. In particular, the production device comprises embossing wheels, which deform the paper web to form a strand of three-dimensional dunnage material. In particular, the embossing wheels provide conveying forces to the paper web. The strand of dunnage material runs into the cutting device, which, in particular in predetermined time- and/or length-intervals, separates a section from the strand of dunnage material. It shall be clear, that also the cutting device can further form or deform the strand of dunnage material and/or provide conveying forces onto the strand of dunnage material.

The removal conveyor behind the cutter device communicates driving forces to the dunnage product in the conveying direction or into a direction having a predominant directional component in the conveying direction, in order to remove the dunnage product form the working area of the cutter device. In particular, the removal conveyor drives the separated dunnage product towards and/or through a dispensing opening in the production device, so that the dunnage product can be further processed by operating personnel. In particular, the removal conveyor transmits driving forces onto the strand of dunnage material at least until immediately before the cutting device or cutter separates the dunnage product from the strand of dunnage material. In particular, the removal conveyor structurally follows up or connects immediately to the cutter in the conveying direction.

In a preferred embodiment, a conveying velocity communicated to the dunnage product and/or to the strand of dunnage material is equal to or larger than the conveying velocity communicated from the delivery conveyor to the paper web. The delivery conveyor determines the delivery velocity with which the paper web is fed to the production device and to the cutter thereof. The removal conveyor grips into the paper web which has been formed into a strand of dunnage material and conveys it with a conveying velocity in the conveying direction which at least confirms to the delivery velocity. Thus it is achieved that the strand of dunnage material is, at least in the moment of separation, held and/or guided by both the delivery conveyor and the removal conveyor. In particular, the cutter is attuned to the removal conveyor and/or the delivery conveyor such that a guidance of the strand of dunnage material is provided even before said separation. Through the removal velocity being at least equal in relation to the delivery velocity it is furthermore ascertained that, after separation of the dunnage product, the front edge of the strand of dunnage material reaches from the delivery conveyor and/or the cutter into the area of influence of the driving force, in particular into the engagement area, of the removal conveyor, without the same coming into an engaging contact with a trailing short edge of the dunnage product.

In a preferred embodiment, the delivery conveyor and/or the removal conveyor are synchronized with the cutter such that, before and/or upon separation of the dunnage product, the delivery conveyor and the removal conveyor communicate conveying forces onto the strand of dunnage material. Is shall be clear that conveying forces can be communicated by a frictional connection, such as a friction- or toothing-engagement, or contact-free, for instance, using a pressurized air impact, onto the strand of dunnage material and/or the paper web or the dunnage product. The cutter separates the strand of dunnage material which runs through the cutter with a conveying velocity provided by the delivery conveyor and/or by the removal conveyor in a temporally attuned manner. In particular, the (delivery) conveying velocity remains constant before and during and/or after the separation. The separation of the dunnage product thus occurs without any loss of time during the conveying flow. Furthermore, it is ascertained that the separated dunnage product receives conveying forces from the moment of separation, these conveying forces inhibiting any unguided remains within the production device so that no paper jam can occur. In particular, the delivery conveyor, the removal conveyor and the cutter comprise respective initial conditions and/or initial positions which are attuned to one another such that, upon an initial passage of a leading section of paper web, the cutter device separates a first dunnage product from the formed strand of dunnage material immediately after the removal conveyor for the first time communicates conveying driving forces to the leading or forward beginning of the strand of dunnage material. In particular, the removal conveyor is controlled synchronously with the cutter such that a dunnage product is separated from the strand of dunnage material always then when the removal conveyor communicates removal conveying forces to the leading edge of the strand of dunnage material.

In a preferred embodiment, the delivery conveyor and/or the removal conveyor and the cutter are attuned relative to one another such that the strand of dunnage material is objected to tensile stress in particular during separation. In particular, the removal conveyor communicates a (removal) delivery velocity to a leading edge of the strand of dunnage material which is preferably slightly higher, such as 1 to 10% higher than the delivery conveyor. In particular, the removal conveyor velocity is increased exclusively shortly before and/or during the separation of the dunnage product. Alternatively or additionally, it can be provided that for creating the tensile stress, a distance between an engagement position of the delivery conveyor into the paper web and an engagement position of the removal conveyor into the strand of dunnage material is temporarily increased. A strand of dunnage material objected to a slight tensile stress allows for an exact tailoring to length. In case cutting tools are utilised for separation, these are subjected to less wear.

In a preferred embodiment, the device comprises a drive transmission which controls and/or drives the delivery conveyor and/or the removal conveyor such that, after separation of a dunnage product, the conveyance of the strand of dunnage material is continued until an (forward) edge of the strand of material forward or leading in the conveyance direction comes into engagement with the removal conveyor. In particular, the drive transmission comprises a sensory device (e.g. sensor) for detecting driving forces and/or comprising a time-control, measuring whether the forward running edge of the strand of dunnage material has come into engagement with the removal conveyor. The drive transmission is configured to keep running after the creation of a dunnage product, in particular without interference of operating personnel, until the strand of dunnage material is guided through both, the delivery conveyor as well as the removal conveyor. Thereby, it is avoided that an end of a strand of dunnage material remains unguided within the production device after the separation of the dunnage product, which could otherwise cause a paper jam in case of a possible starting-up of the production device.

In a preferred embodiment, the delivery conveyor and/or the removal conveyor comprise a respective wheelwork. In particular, the wheelwork engages at least one of the paper web, the strand of dunnage material, and the dunnage product, between two conveyor wheels, particularly being arranged opposite one another along the conveying direction. Preferably, the delivery conveyor and the removal conveyor each comprise one respective wheelwork. In particular, the wheelwork of the delivery conveyor is realized as a pair of embossing wheels which forms a paper web into a strand of dunnage material. Preferably, the wheelwork transports the paper web, the strand of dunnage material, and/or the dunnage product along the conveyor direction, and/or along a passage direction defined by a common tangent on the respective outer circumference of the conveyor wheel of the wheelwork. In particular, the passage direction is the same as the conveyor direction. Alternatively, it can be provided that the passage directions of a wheelwork of the delivery conveyor and of a wheelwork of the removal conveyor cross each other with an angle of less than 45° and more than 5°.

In a preferred embodiment, the delivery conveyor and/or the removal conveyor particularly each comprise a wheelwork with two respective conveyor wheels, particularly being arranged laterally opposite to one another relative to the conveying direction. In particular, the conveyor of each respective wheelwork comprises different wheel diameters. Preferably, the distances of the axes of the conveyor wheels of the respective wheelwork are undersized relative to the wheel diameters, or with respect to the sum of the radii of the two conveyor wheels, such that the conveyor wheels are elastically biased against one another. Through the elastic biasing, a sufficient driving force transmission onto the strand of dunnage material and/or onto the dunnage product can be ascertained even in case of profile-free conveyor wheels. Reaching through the delivery conveyor or through the removal conveyor into the area of the cutter is impaired by the elastic pretensioning.

In a preferred embodiment, the delivery conveyor and/or the removal conveyor each comprise at least one respective conveyor wheel. Preferably, the at least one conveyor wheel comprises an elastically deformable rolling circumference for a rolling surface. In particular, the conveyor wheel is made of an elastomer body, such as a PU-foam-body. In particular, the conveyor wheel comprises a toothing. Preferably, the delivery conveyor and/or the removal conveyor each comprise two respective conveyor wheels, one comprising a toothing and the other conveyor wheel comprising a complementary toothing into which the toothing of the first conveyor wheel engages, particularly transmitting driving forces. Via a tractional connection transmitting driving forces between the conveyor wheels, particularly of the delivery conveyor and/or of the removal conveyor, a driving force transmission onto the paper web and/or onto the strand of dunnage material can be reliably provided without having to power both conveyor wheels. This enables a cost-efficient design of the production device.

In a preferred embodiment, the cutter comprises a rotary cutter which in particular comprises two tool parts arranged laterally opposite one another relative to the conveying direction, each being mounted on a respective shaft. In particular, the rotary cutter comprises a cutting pad on one tooth part and a blade on the opposing tooth part. In particular, the preferably essentially rectilinear blade extends across, preferably essentially perpendicularly, to the conveying direction. In particular, the blade is arranged leading and/or trailing edge relative to at least one perforation-nose and/or slot reception. Preferably, one tool part comprises the at least one perforation nose and the other tool part comprises the at least one slot reception into which the perforation nose engages during one rotation of the rotary cutter.

In a preferred embodiment, the device comprises a preforming station which in particular is arranged succeeding or preceding the delivery conveyor in the conveying direction and which forms the paper web into a strand of three-dimensional dunnage material. In particular, the preforming station is formed by a funnel for shaping the paper web and/or by a wheelwork of the delivery conveyor engaging the paper web in a conveying- and/or embossing-engagement.

In a preferred embodiment, the cutter comprises a perforation tool for inserting a perforation into the strand of dunnage material comprising at least one perforation nose, at least one perforation reception and at least one stripper (which may be called a wiper or scraper). In particular, the perforation nose and the at least one perforation reception, such as a slot reception, are associated with one another, so that for perforation, the at least one perforation nose can extend and retract relative to the at least one perforation reception, such as the slot reception. In particular, the stripper or scraper is associated with the at least one perforation nose and/or with the at least one perforation reception such that, when retracting, the perforated strand of dunnage material is removed from the at least one perforation nose and/or from the at least one perforation reception. In an exemplary embodiment, the perforation tool is realized in accordance with the German patent application number 10 2013 015 875.3 filed on Sep. 23, 2013, which is incorporated herein by reference in its entirety.

In FIGS. 1 and 2, a device 10 for machine-making or machine-producing dunnage material in accordance with the invention is generally designated with reference numeral 10. In the illustrations, the production device 10 is shown without external housings so that the vision onto the housing carrier 13 and to the components of the production device 10 relevant for the invention is unimpaired. The production device 10 comprises a delivery conveyor 2 discharging a paper web not being shown in further detail and which is present in roll- or stack-shape from a paper reception, for example by unwinding from a roll or ablating from a stack and by drawing into the production device 10 in a conveying direction F.

The delivery conveyor 2 comprises a delivery funnel 21, tapering from a paper reception not being shown in further detail towards a transportation channel extending through the housing carrier in its extension direction, the transportation channel mounding at a dispensing opening 9 or outlet opening. The delivery conveyor further comprises a wheelwork 23 immediately attached to the delivery funnel 21, the wheelwork 23 being rotatably mounted in the housing carrier 11 and communicating conveying forces to the paper web tangentially relative to the wheels. During the delivery of the paper web through the funnel 21, the hose- or web-shaped, unrolled paper web is compressed in its volumetric extension radially with respect to the conveyor direction F, so that, by knitting and folding individual paper web sections, hollow air chambers are formed which determine a cushioning effect of the dunnage material product to be made.

The wheelwork 23 of the delivery conveyor 2 is formed by two conveying wheels 23*a*, 23*b* being arranged opposite one another along the transportation channel, of which preferably only one is rotationally driven or powered (not shown in further detail). The rotary drive can be accessed via a transmission not being shown in further detail or via a tooth-belt-system from a drive transmission 120. The second conveyor wheel 23*b* of the wheelwork 23 is essentially mounted in a freely rotatable manner. The conveying wheels 23*a*, 23*b* are mutually engaging so that the driving forces from the powered conveying wheel 23*a* are communicated to the second conveying wheel 23*b*. As can be seen in FIG. 2, the rotational shaft 25*b* of the freely rotatable conveying wheel 23*b* and the rotational shaft 25*a* of the rotational wheel 23*a* are arranged within the housing carrier 13 with a radial distance to one another undersized relative to the respective maximal outer diameters of the conveying wheels, so that a conveying wheel overlap and thus a conveying contact area 26 is realized between the conveying wheels 23*a*, 23*b*. The conveying wheels 23*a*, 23*b* are elastically pretensioned against one another.

The powered or driven conveyor wheel 23*a* is provided with an elastically deformable rolling surface 24, such as a foam plastic running surface, which elastically deforms in the contact area 24 relative to the co-driven conveying wheel 23*b*. Both conveying wheels 23*a*, 23*b* can be predominantly or completely made of an elastic material, such as foam plastic, or such as the conveying wheel 23*a*, comprise an elastic rolling surface 24 or an elastic running surface for instance made of foamed plastic. Alternatively, the conveying wheels 23*a*, 23*b* are realized as toothed wheels or gears engaging one another and the paper web in which additionally an embossing of air entrapments into the paper web to form a strand of a dunnage material product.

The wheel work 23 engages the paper web through the funnel 21 and forms, based on the pressure forces acting upon the pre-shaped paper web between the conveying wheels 23*a*, 23*b* knits and folds into the paper web so that a three-dimensional strand of dunnage material including cushioning air entrapments is formed. The conveying direction F is specifically defined by a common tangent on the two conveying wheels 23*a*, 23*b* of the delivery conveyor 2. Alternatively, the conveying direction F can be defined by the strand-passage-extension of the paper web or of the strand of dunnage material while passing through the device 10. The funnel 21 and the wheelwork 23 of the delivery conveyor 1 together form a preforming station. An example, for a delivery conveyor serving as a deformation means is given by the preforming station according to DE 10 2012 018 941 A1 the content of which shall herewith be expressively incorporated into the description of the figures.

In the conveying direction F, also a cutting arrangement or cutter 4 follows up the delivery conveyor, preferably also being arranged within the housing carrier. The cutter comprises a perforation tool of the kind such as known from the German patent application number 10 2013 015 875.3 with the application date Sep. 23, 2013, the content of which shall be expressly incorporated herein by reference into the description of the figure.

The perforation tool covers two tool parts 127, 129 arranged opposite one another essentially symmetrically relative to the conveying direction. The tool parts 127, 129 are each rotatably mounted on a respective shaft 27, 27' within the housing carrier 13. One tooth part comprises a blade 37 for severing a strand of dunnage material transported in the conveying direction F within the course of one rotation of the shaft 27. A second tool part which turns synchronously relative to the first around the shaft 27' comprises a cutting pad 183. The cutting pad 183 and the blade 37 come into a cutting engagement for separating the dunnage product from the strand of dunnage material. The shafts 27, 27' are rotationally driven by a respective driving gear 161, 161' rotationally driving the rotary cutter formed by the blade 37 and the cutting pad 183. The gears or tooth wheels 161, 161' each comprise rotationally symmetrically arranged along their respective circumference, uniformly disposed particular circular material recesses 163. With the material recesses 163 or material apertures, the weight of the driving gears 161, 161' is reduced and their rotational inertia is decreased.

In the conveying direction F immediately succeeding the cutter 4, a removal conveyor 6 is connected. The removal conveyor 6 comprises two conveying wheels 61, 63, the rotary shafts 69, 69' of which being arranged on opposite sides of a conveying or transportation channel extending along the conveying direction F of the housing carrier 13. The conveying wheel 61 comprises a larger diameter than the conveyor wheel 63. The shaft 69' of the conveyor wheel 63 is arranged with a smaller distance to the shaft 27' of the cutter 4 from the shaft 69 to shaft 27. The distance of the shafts 69, 69' of the removal conveyor is undersized relative to the respective maximal outer diameters of the conveyor wheels 61, 63, so that a contact area 66 between the conveyor wheels 61, 63 is standing under a compression of stress bias is realized. Due to the arrangement of the shaft 69, 69', not being exactly perpendicular to the conveying direction F opposite one another or being offset in the conveying direction F, the removal conveying direction D between the conveying wheels 61, 63 which crosses the conveying direction F defined by the delivery conveyor and/or by the extension of the housing carrier. The removal conveying direction D is determined by a common tangent on the conveying wheels 61, 63. The conveying wheels 61, 63 comprise an elastic running surface predominantly or completely being made of an elastic material, such as foam plastic.

The dispensing opening 9 of the device 10 is covered by a pivotably mounted flap 91. The flap 91 is of the check-valve type. In particular, the flap 91 is mounted in the dispensing opening 9 such that the removal direction D through the conveying wheels 61, 63 stands essentially perpendicular to the closed flap 91.

The shaft 69 of the conveying wheel 61 comprises a driving pinion gear 68. The drive transmission 120 drives a sprocket 121 or pinion transferring rotational driving forces via a toothed belt 123 onto the driving pinion 68 of the removal conveyor 6. A tension pulley 28 or deflection pulley is arranged within the housing carrier 13 relative to the driving pinion 121 and the tooth belt 123 such that it applies a pretension perpendicular to the running direction of the tooth belt 123 onto the tooth belt. The tension and deflection roller 28 contacts the un-toothed outer surface of the toothed belt 123 in order to deflect the tooth belt. The drive transmission 120 further creates driving forces for the cutter 4. The driving forces are transferred over toothed wheels or gears 161, 161' onto the cutter 4 which is not shown in further detail in the figures for improved clarity.

The rotational velocity of the wheelwork 23 of the delivery conveyor 2 is attuned relative to the rotational velocity of the conveyor wheels 61, 63 of the removal conveyor 6 as well as to the rotational velocity of the cutter 4 such that the cutter 4 achieves a cutting position only then when a strand of dunnage material provided by the delivery conveyor 2 comes into engagement with the conveyor wheels 61, 63 of the removal conveyor 6. The cutting position is defined by the blade 37 standing in contact with the cutting pad 183 and particularly being arranged parallel thereto. Furthermore, it can be provided that the device comprises a predetermined maintenance position for initial operation in order to define the position of the cutter device 4, in particular of the rotational cutter.

The respective wheelwork 23, 62 of the delivery conveyor 2 and of the removal conveyor 6 as well as the gears 161, 161' of the cutter device 4 work synchronously in particular with different speeds. That is, the conveying wheels 23*a*, 23*b*, 61, 63 and the gears 161, 161' rotate with a predetermined temporal- and velocity-ratio relative to one another.

The drive transmission 120 can be configured via a sensory device or temporal control which is not shown in further detail such that, after cutting a dunnage product from a strand of dunnage material, at least the delivery conveyor 2 continues running until the frontal leading edge of the strand of dunnage material trailing behind a forward dunnage product comes into engagement with the removal conveyor 6. Thereby it is ascertained that the assembly stops in a predetermined operating condition so that no paper jam can occur during of the procedure.

Preferably, the rotary velocity of the cutting device 4 is attuned relative to the rotational velocity of the delivery conveyor 2 and that of the removal conveyor 6 such that, within one rotation between cutting position and cutting position, a predetermined length of the strand of dunnage material passes along the conveying direction F through the device 10. Preferably, the velocity of the cutter is adjustable relative to the conveying velocity of the delivery 2 and relative to the removal conveyor 6 in order to set the length of the dunnage product to be made. Preferably, the rotary velocities are synchronized in a predetermined ratio relative to one another. This objective is achieved using a transmission of the drive transmission 120 as well as through a transmission provided by the driving sprocket 121, the delivery conveyor, the driving sprocket 68 and the gears 161, 161'.

The procedure of production of one dunnage product is realized as follows: The paper web is drawn into the device 10 through the delivery conveyor 2 in the conveying direction F along the longitudinal extent of the housing carrier 13 and is pre-shaped into a three-dimensional strand of dunnage material during the passage of the wheelwork 23 of the delivery conveyor 2. The delivery conveyor velocity of the delivery conveyor 2 is thereby attuned synchronously to the rotational velocity of the rotary cutter of the cutting device 4 in its predetermined initial rotary position such that the wheelwork 62 of the removal conveyor 6 comprising the conveyor wheels 61, 63 comes into a conveying engagement with the strand of dunnage material before the blade 37 of the cutter 4 reaches its cutting position so as to cut the dunnage product from the strand of dunnage material.

The removal conveyor 6 brings a removed velocity onto the dunnage product larger than or equal to the conveyance velocity brought onto the strand of dunnage material by the delivery conveyor 2. Thereby it is ascertained that no paper jam occurs. Preferably, the strand of dunnage material is guided within the device under tensile stress in the moment of separation through a higher removal conveyance velocity increased by between 0.1% and 20%, particularly between 0.1% and 10%, preferably between 0.1% and 5%.

The dunnage material product is subsequently transported through the removal conveying device 6 in the direction of the dispensing opening 9 wherein the conveying velocity is large enough in order to push open the closure flap 91. Alternatively, the drive transmission 120 opens the closure flap 91 at intervals or in a predetermined temporal distance to the separation, in synch with the cutter 4 and/or with the removal conveyor 6.

The blade 37 of the cutter 4 is integrated into a perforator tool having nose tool parts 127 and reception tool part 129, which, during the separation of the dunnage product, produce form-retaining-perforations on the trailing dunnage product edge and on the forward leading edge of the dunnage material. The reception tool 129 comprises a cutting pad 183 and slot recesses 177*a*, 177*b* or slot apertures, into which the perforating noses 45*a*, 45*b* of the opposing nose tool part 127 penetrate. In the nose tool part 129, a stripper 57 is provided being realized as a bar of PU-foam in order to remove the strand of dunnage material from the perforation tool after perforating.

The features disclosed in the above description, the figures and the claims can be of importance for realizing the invention in the different embodiments thereof individually or in any combination thereof.

LIST OF REFERENCE NUMERALS

2 delivery conveyor
4 cutter
6 removal conveyor
9 dispensing opening
10 device
13 housing carrier
21 funnel
23, 62 wheelwork
23*a*, 23*b*, 61, 63 conveying wheels
24 rolling surface
25*a*, 26*b* shaft
26, 66 conveying contact area
27, 27', 69, 69' shaft
28 driving pinion
37 blade
45*a*, 45*b* perforating nose
57 stripper
68 driving pinion gear
91 flap
120 drive transmission
121 driving sprocket
123 toothed belt
127 nose tool part
129 reception tool part
161, 161' driving gear
163 recess
183 cutting pad
177*a*, 177*b* slot reception
D passage direction
F conveying direction
R rotational direction

The invention claimed is:

1. A device for machine-making a dunnage product from a single-ply or multi-ply paper web, the device comprising:

a delivery conveyor configured to draw the paper web into the device in a conveying direction;

a cutter configured to separate the dunnage product from a three-dimensional strand of dunnage material formed from the paper web within the device;

a removal conveyor positioned after the cutter in the conveying direction and configured to remove the separated dunnage product from the cutter, wherein the removal conveyor is configured to communicate a removal delivery velocity to a leading edge of the three-dimensional strand of dunnage material that is between 0.1% and 20% greater than a velocity of the delivery conveyor; and a drive transmission including:

a sensor configured to detect driving forces, and/or a time control configured to measure whether the leading edge of the strand of dunnage material has come into engagement with the removal conveyor, wherein the drive transmission is configured to control the removal conveyor synchronously with the cutter such that the dunnage product is always separated from the three-dimensional strand of dunnage material when the removal conveyor communicates the removal delivery velocity to the leading edge of the three-dimensional strand of dunnage material.

2. The device according to claim 1, wherein the drive transmission is configured such that a conveying velocity provided by the removal conveyor to the dunnage product and/or to the strand of dunnage material is greater than A conveying velocity provided by the delivery conveyor to the paper web.

3. The device according to claim 1, wherein the delivery conveyor and/or the removal conveyor are synchronized with the cutter such that the delivery conveyor and/or the removal conveyor provide conveying forces to the strand of dunnage material before and/or during separation of the dunnage product.

4. The device according to claim 1, wherein the delivery conveyor and/or the removal conveyor and the cutter are attuned such that the strand of dunnage material is subjected to tensile stress during its separation.

5. The device according to claim 1, wherein the drive transmission is configured to control the delivery conveyor and/or the removal conveyor such that conveying of the strand of dunnage material is continued after separation of the dunnage product, until the leading edge of the strand of dunnage material moving forward in the conveying direction comes into engagement with the removal conveyor.

6. The device according to claim 1, wherein the delivery conveyor and/or the removal conveyor comprises a wheelwork including two conveying wheels, the wheelwork being configured to grip at least one of the paper web, the strand of dunnage material, and the dunnage product between the two conveying wheels and transport the gripped at least one of the paper web, the strand of dunnage material, and the dunnage product along a passage direction defined by a common tangent on each respective outer circumference of the two conveying wheels of the wheelwork.

7. The device according to claim 1, wherein the delivery conveyor and the removal conveyor each comprises a wheelwork having two conveying wheels laterally opposite one another relative to the conveying direction, the two conveying wheels comprising different wheel diameters and/or a wheel-center-to-wheel-center distance being undersize relative to the wheel diameters such that the two conveying wheels are elastically biased against each other.

8. The device according to claim 1, wherein the delivery conveyor and/or the removal conveyor each comprises at least one conveying wheel including a deformable rolling surface, the at least one conveying wheel being made of an elastomer body and/or comprising a toothing configured to engage into a toothing of a respective opposing conveying wheel force-transmittingly.

9. The device according to claim 1, wherein the cutter comprises:

a rotary cutter including two tool parts being mounted on respective shafts.

10. The device according to claim 9, wherein the two tool parts comprise: a blade and a cutting pad, the blade being a rectilinear blade that extends orthogonally to the conveying direction.

11. The device according to claim 10, wherein at least one perforating nose and/or slot reception is arranged leading before and/or lagging behind the blade in a rotational direction.

12. The device according to claim 1, wherein the device further comprises a preforming station arranged downstream of the delivery conveyor in the conveying direction, the preforming station being configured to form the paper web into the three-dimensional strand of dunnage material.

13. The device according to claim 12, wherein the preforming station comprises:

a funnel configured to form the paper web; and a wheelwork of the delivery conveyor that is configured to engage the paper web in a conveying engagement and/or an embossing engagement.

14. The device according to claim 1, wherein the cutter comprises:

a perforator tool configured to introduce a perforation into the strand of dunnage material, the perforator tool comprising at least one perforator nose, at least one perforator reception, and at least one stripper, wherein the at least one perforator nose and the at least one perforator reception are associated with one another such that, for perforating, the at least one perforator nose is configured to extend and retract relative to the at least one perforator reception, and/or wherein the at least one stripper is associated with the at least one perforator nose and/or with the at least one perforator reception such that upon retraction of the at least one perforator nose, the perforated dunnage product is removed from the at least one perforator nose and/or from the at least one perforator reception.

15. The device according to claim 1, wherein the cutter comprises:

a perforator tool configured to introduce a perforation into the strand of dunnage material, the perforator tool comprising at least one perforator nose, at least one perforator reception, and at least one stripper, wherein:

the at least one perforator nose and the at least one perforator reception are associated with one another such that, for perforating, the at least one perforator nose is configured to extend and retract relative to the at least one perforator reception, and the at least one stripper is associated with the at least one perforator nose and/or with the at least one perforator reception such that upon retraction of the at least one perforator nose, the perforated dunnage product is removed from the at least one perforator nose and/or from the at least one perforator reception.

16. The device according to claim 1, wherein a velocity of the cutter is adjustable relative to the velocity of the delivery conveyor, and relative to the removal delivery velocity communicated by the removal conveyor, to set a length of the dunnage product.

17. A device for machine-making a dunnage product from a single-ply or multi-ply paper web, the device comprising:

a delivery conveyor configured to draw the paper web into the device in a conveying direction;

a cutter configured to separate the dunnage product from a three-dimensional strand of dunnage material formed from the paper web within the device;

a removal conveyor positioned after the cutter in the conveying direction and configured to remove the separated dunnage product from the cutter; and a drive transmission configured to operatively couple the delivery conveyor, the removal conveyor, and the cutter to work synchronously with different speeds in a predetermined velocity-ratio relative to one another, wherein the removal conveyor is configured to communicate a removal delivery velocity to a leading edge of the three-dimensional strand of dunnage material that is greater than a velocity of the delivery conveyor, the velocity of the delivery conveyor being larger than zero and remaining constant before and during the separation.

18. The device according to claim 17, wherein the drive transmission is configured such that the separating of the dunnage product from the three-dimensional strand of dunnage material occurs without any loss of time while conveying at the constant velocity of the delivery conveyor.

19. The device according to claim 17, wherein the drive transmission is configured such that the three-dimensional strand of dunnage material is conveyed through the cutter at the velocity of the delivery conveyor.

20. The device according to claim 17, wherein the drive transmission is configured such that the velocity of the delivery conveyor remains constant before, during, and after the separation.

21. The device according to claim 17, wherein the drive transmission is configured to increase the removal delivery velocity of the removal conveyor exclusively shortly before and/or during the separation of the dunnage product.

22. A device for machine-making a dunnage product from a single-ply or multi-ply paper web, the device comprising:

a delivery conveyor including a wheelwork configured to draw the paper web into the device in a conveying direction;

a cutter configured to separate the dunnage product from a three-dimensional strand of dunnage material formed from the paper web within the device, the cutter having a rotary cutter that includes a cutting pad on a first tool part and a blade on a second tool part that opposes the first tool part;

a removal conveyor positioned after the cutter in the conveying direction and including conveyor wheels configured to remove the separated dunnage product from the cutter, wherein the removal conveyor is configured to communicate a removal delivery velocity to a leading edge of the three-dimensional strand of dunnage material that is greater than a velocity of the delivery conveyor; and a drive transmission configured to synchronize a rotational velocity of the wheelwork relative to a rotational velocity of the conveyor wheels and to a rotational velocity of the rotary cutter in a predetermined ratio relative to one another.

23. The device according to claim 22, wherein the drive transmission comprises:

a driving sprocket of the rotary cutter;

gears of the rotary cutter;

a driving sprocket of the removal conveyor; and/or a toothed belt.

* * * * *